US005740874A

United States Patent [19]

Matthias

[11] Patent Number: 5,740,874

[45] Date of Patent: Apr. 21, 1998

[54] CUTTING ELEMENTS FOR ROTARY DRILL BITS

[75] Inventor: Terry R. Matthias, Longlevens, England

[73] Assignee: Camco Drilling Group Ltd. of Hycalog, Stonehouse, England

[21] Appl. No.: 635,110

[22] Filed: Apr. 19, 1996

[30] Foreign Application Priority Data

May 2, 1995 [GB] United Kingdom ..... 9508892

[51] Int. Cl.[6] ..... E21B 10/46

[52] U.S. Cl. ..... 175/430; 175/431

[58] Field of Search ..... 175/430, 431, 175/432, 428

[56] References Cited

U.S. PATENT DOCUMENTS

| | | | |
|---|---|---|---|
| 4,221,270 | 9/1980 | Vezirian | 175/430 |
| 4,705,122 | 11/1987 | Wardley et al. | 175/430 |
| 4,724,913 | 2/1988 | Morris | 175/430 |
| 5,379,853 | 1/1995 | Lockwood et al. | 175/428 |
| 5,383,527 | 1/1995 | Azar | 175/431 |
| 5,437,343 | 8/1995 | Cooley et al. | 175/431 |
| 5,469,927 | 11/1995 | Griffin | 175/432 |

FOREIGN PATENT DOCUMENTS

| | | | |
|---|---|---|---|
| 2211872 | 7/1989 | United Kingdom | 175/432 |
| 2294069 | 4/1996 | United Kingdom . | |

*Primary Examiner*—Hoang C. Dang

[57] ABSTRACT

A preform cutting element for a rotary drag-type drill bit includes a facing table of polycrystalline diamond having a rear surface bonded to a tungsten carbide substrate. The cutting element is formed with an angled chamfer to form a straight cutting edge on the facing table. The junction between one end of the cutting edge and the remainder of the peripheral surface of the facing table is chamfered in a part-circular arc to provide a smooth transition between the cutting edge and the rest of the peripheral surface. Such transition may reduce the spalling or other damage which may be caused by steady state and impact loads in this region.

51 Claims, 2 Drawing Sheets

CUTTING ELEMENTS FOR ROTARY DRILL BITS

BACKGROUND OF THE INVENTION

1. Field of the Invention

The invention relates to cutting elements for rotary drill bits and particularly to preform cutting elements for use in rotary drag-type drill bits for ailing or coring holes in subsurface formations. The preform elements are of the kind comprising a facing table of superhard material having a front face, a peripheral surface, and a rear surface bonded to a substrate of material which is less hard than the superhard material.

2. Description of Related Art

The facing table is usually formed from polycrystalline diamond, although other superhard materials are available, such as cubic boron nitride. The substrate of less hard material is often formed from cemented tungsten carbide, and the facing table and substrate are bonded together during formation of the element in a high pressure, high temperature forming press. This forming process is well known and will not be described in detail.

Each preform cutting element may be mounted on a carrier in the form of a generally cylindrical stud or post received in a socket in the body of the drill bit. The carrier is often formed from cemented tungsten carbide, the rear surface of the substrate being brazed to a surface on the carrier, for example by a process known as "LS bonding". Alternatively, the substrate itself may be of sufficient thickness to provide, in effect, a cylindrical stud which is sufficiently long to be directly received in a socket in the bit body, without being brazed to a carrier. The bit body itself may be machined from metal, usually steel, or may be molded using a powder metallurgy process.

In one common form of drill bit, the operative end face of the bit body is formed with a number of blades radiating from the central area of the bit, the blades carrying cutting elements spaced apart along the length thereof. The bit also has a gauge section including kickers which contact walls of the borehole to stabilize the bit in the borehole. It is common practice to mount on the bit body, in the intermediate region where the kickers meet the blades, so-called gauge cutters the purpose of which is to cut and form the side walls of the borehole as the cutting elements on the blades cut into the bottom of the borehole and the drill bit progresses downwardly.

The cutting elements mounted on the blades on the end face of the bit body are commonly initially circular so as to provide a part-circular cutting edge to engage the formation at the bottom of the borehole. Gauge cutters, however, commonly have a substantially straight cutting edge which, in use, extends generally parallel to the longitudinal rotational axis of the drill bit so as to cut the side walls of a cylindrical borehole.

All such cutting elements are subjected to extremes of temperature during formation and mounting on the bit body, and are also subjected to high temperatures and heavy loads, such as impact loads, when the drill is in use down a borehole. It is found that as a result of such conditions spalling and delamination of the superhard facing table can occur, that is to say the separation and loss of the diamond or other superhard material over the cutting surface of the table. The present invention sets out to provide a novel form of preform cutting element, particularly suitable for use as a gauge cutter, which may be less susceptible than prior art gauge cutters to such spalling and other forms of damage.

SUMMARY OF THE INVENTION

According to the invention there is provided a preform cutting element for a rotary drag-type drill bit including a facing table of superhard material having a front face, a peripheral surface, and a rear surface bonded to a substrate of a material which is less hard than the superhard material, the peripheral surface of the cutting element including a substantially straight cutting edge having at opposite ends thereof junctions with the remainder of said peripheral surface, at least one of said junctions being formed with a chamfer which provides a transition between the end of the cutting edge and the adjacent portion of the remainder of the peripheral surface of the cutting element.

In some cases both junctions may be chamfered. Although said transition chamfer may be angled, preferably the chamfer is smoothly curved to provide a continuous transition between the end of the cutting edge and the adjacent portion of the remainder of the peripheral surface. For example, the chamfer may be in the form of a part-circular arc, opposite ends of which are substantially tangential to the cutting edge and the remainder of the peripheral surface respectively. In the case where both junctions are in the form of part-circular arcs, the arcs may be of the same, or different, radii.

It is considered that the chamfering of one or both junctions between the cutting edge and the remainder of the peripheral surface may reduce the high contact loading, both steady state and impact loads, which may occur at these locations, and thus reduce the spalling or other damage which may be initiated or caused by such loads.

In a preferred embodiment of the invention, the remainder of the peripheral surface of the cutting element is part-circular. Said part-circular portion of the peripheral surface preferably has an angular extent which is greater than 180, for example it may be in the range of 210–270.

In the case where the chamfer is in the form of a part-circular arc, and said remainder of the peripheral surface of the cutting element is part-circular, the ratio of the radius of curvature of the chamfer to the radius of curvature of the peripheral surface may be in the range of 1:1.4 to 1:1.8.

For example, if the radius of curvature of the peripheral surface is 6.5 mm, the radius of curvature of the chamfer may be about 4 mm, and if the radius of curvature of the peripheral surface is 9.5 mm the radius of curvature of the chamfer may be about 6.5 mm. Cutters of 4 mm and 2.5 mm radius are also used, and the invention is applicable to cutters of any size.

DETAILED DESCRIPTION OF THE PREFERRED EMBODIMENTS

Figure 1:
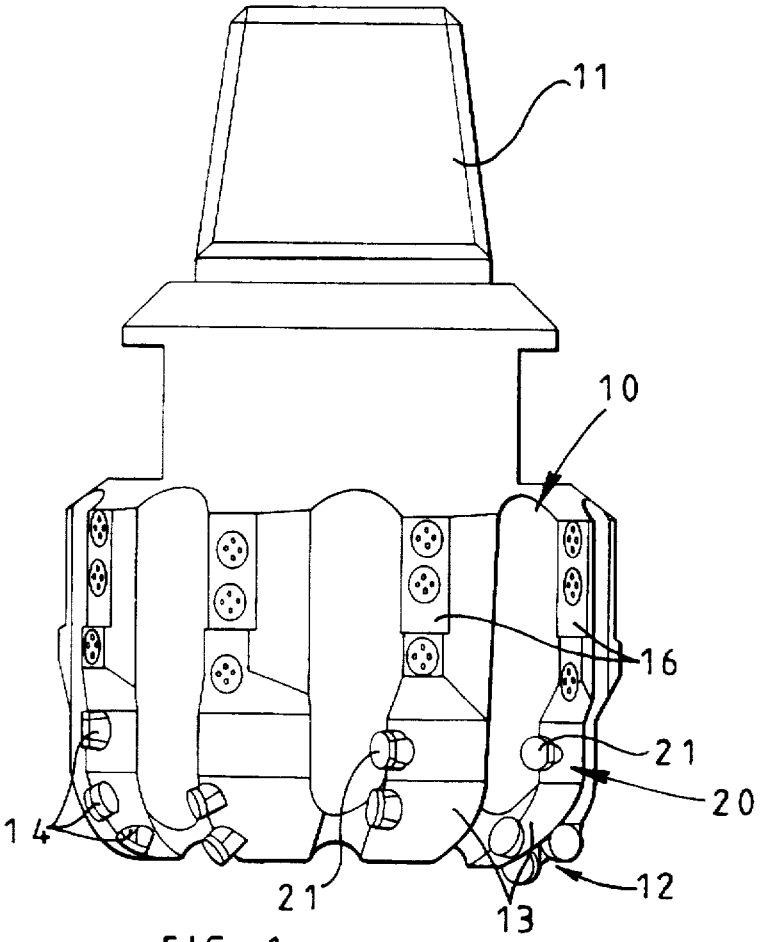
FIG. 1 is a side elevation of a typical drag-type drill bit in which cutting element according to the present invention may be used.
Figure 2:
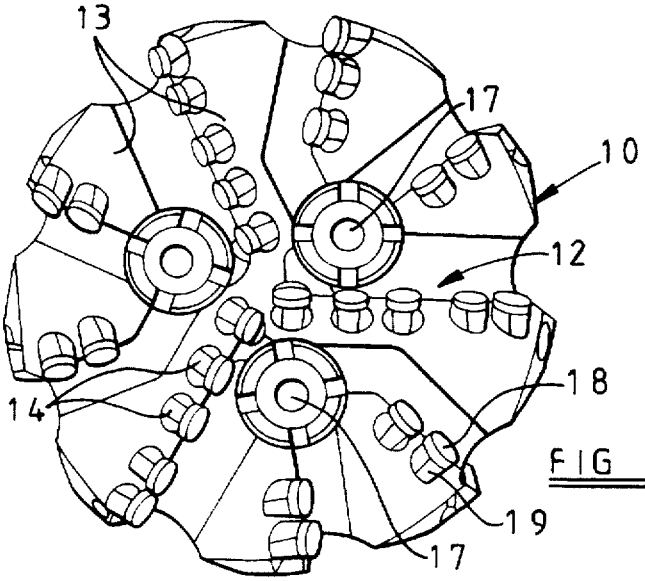
FIG. 2 is an end elevation of the drill bit shown in FIG. 1.

FIGS. 1 and 2 show a typical full bore drag bit of a kind to which the cutting elements of the present invention are applicable. The bit body 10 is machined from steel and has a shank formed with an externally threaded tapered pin 11 at one end for connection to the drill string. The operative end face 12 of the bit body is formed with a number of blades 13 radiating from the central area of the bit, and the blades carry cutter assemblies 14 spaced apart along the length thereof. The bit has a gauge section including kickers 16 which contact the walls of the borehole to stabilize the bit in the borehole. A central passage (not shown) in the bit and shank delivers drilling fluid through nozzles 17 in the end face 12 in known manner.

Each cutter assembly 14 comprises a preform cutting element 18 mounted on a carrier 19 in the form of a post which is located in a socket in the bit body. Each preform cutting element is the form of a tablet comprising a facing table of superhard material, usually polycrystalline diamond, bonded to a substrate which is normally of cemented tungsten carbide. The rear surface of the substrate is bonded, for example by LS bonding, to a suitably orientated surface on the post 19.

Figure 3:
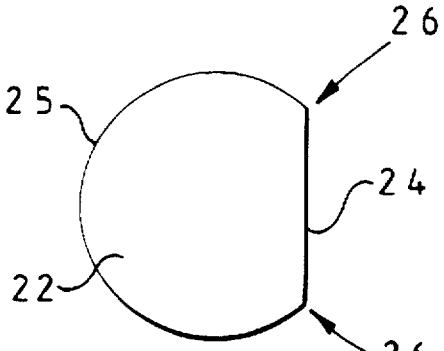
FIG 3 (Prior art)
FIG. 3 is a plan view of a prior art gauge cutter used in such drill bit.
Figure 4:
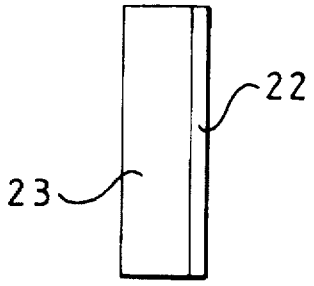
FIG 4 (Prior art)
FIG. 4 is a diagrammatic section through the prior art gauge cutter of FIG. 3.

The cutting elements 18 mounted on the operative end face 12 of the bit body are commonly initially in the form of circular tablets so as to provide a part-circular cutting edge so that the cutting elements cut concentric grooves in the bottom of the borehole. However, in an intermediate region 20 of the bit body, at the junction between the blades 13 and the kickers 16, the cutter assemblies comprise gauge cutters 21 of a different form. As best seen in FIGS. 3 and 4, each gauge cutter normally comprises a facing table 22 of polycrystalline diamond or other superhard material bonded to a substrate 23 of a less hard material such as cemented tungsten carbide. The gauge cutter has a substantially straight cutting edge 24, the remainder of the peripheral surface 25 of the cutting element being part-circular. In use the gauge cutter is orientated on the bit body, in the intermediate region 20, so that the straight cutting edge 24 extends generally parallel to the central longitudinal rotational axis of the drill bit and therefore forms the cylindrical side walls of the borehole as drilling progresses.

In the prior art arrangement the junctions between the opposite ends of the straight cutting edge 24 and the rest of the peripheral surface 25 of the cutting element are sharply angled, as indicated at 26 in FIG. 3. It is believed that the sharp angling of these junctions can lead to stress concentrations at the junctions, when the drill bit is in use, both as a result of steady state loads and also as a result of impact loads of short duration. It is believed that this stress concentration can initiate spalling and other forms of damage to the cutting element resulting in loss of cutting efficiency, or at worst failure, of the cutting element.

Figure 5:
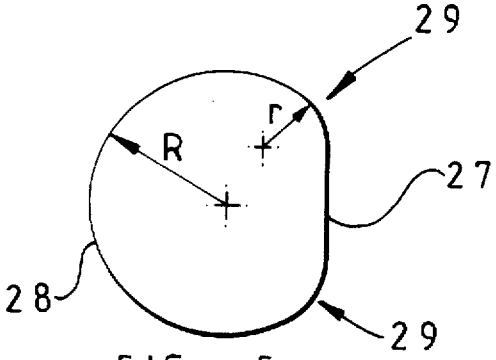
FIG. 5 is a plan view of a gauge cutter in accordance with the present invention.
Figure 6:
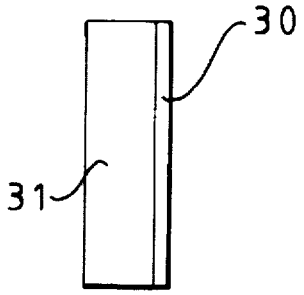
FIG. 6 is a diagrammatic section through the gauge cutter of FIG. 5.

FIGS. 5 and 6 show one improved form of gauge cutting element according to the present invention. In the arrangement according to the invention the overall shape of the gauge cutting element is generally similar to the prior art arrangement in that it comprises a substantially straight cutting edge 27 and the rest of the peripheral surface 28 of the cutting element is part-circular. However, in accordance with the present invention, the junctions 29 between the opposite ends of the straight cutting edge and the remainder of the peripheral surface 28 of the cutting element are both chamfered to provide a gradual transition between the ends of the cutting edge and the peripheral surface so as to reduce stress concentrations in this region. In the arrangement shown the chamfer is in the form of a part-circular arc. In the case where the remainder of the peripheral surface of the cutting element has a radius R of 9.5 mm the radius of curvature r of the chamfer 29 may be about 6.5 mm. Similarly, if the radius of curvature R is 6.5 mm, the radius of curvature r of the chamfer may be about 4 mm. It will be seen that the ends of the arcuate chamfer are tangential to the cutting edge 27 and the remainder of the peripheral surface 28 respectively.

As will be seen, the angular extent of the peripheral surface 28 of the cutting element is greater than 180, and may for example be in the range of 210–270. Instead of both junctions being chamfered, as shown, only one of the junctions may be chamfered. This is preferably the junction which is lowermost when the bit is drilling downwardly, since this is the junction which is most subject to impact and damage. The advantage of chamfering only one of the junctions is that it causes less reduction in the length of the straight cutting edge.

As in the prior art arrangement the cutting element comprises a facing table 30 of polycrystalline diamond, or other superhard material, bonded to a substrate 31 of less hard material, such as cemented tungsten carbide.

Although the chamfers 29 are preferably in the form of part-circular arcs, other smoothly curved arrangements may provide similar advantage. Some advantage may also be given by chamfers which are not smoothly curved, for example the junctions may be provided with one or more angled chamfers, but in this case the reduction in stress concentration may be less. The part-circular configuration of the rest of the peripheral surface of the cutting element is shown by way of example only, and it will be appreciated that other shapes of cutting element may be employed.

The cutting edge 27 and chamfers 29 may be formed by shaping an initially circular cutting element. The shaping may, for example, be effected by grinding, EDM or other suitable shaping process. Alternatively, the cutting element may be manufactured to the required shape ab initio in the high pressure, high temperature forming process. The diamond layer 30, and the substrate 31, may also be chamfered as viewed in cross-section, the chamfer being tangential to the surface of the formation which the cutter engages, so that the part of the cutter rearwards of the cutting edge serves as a buttress to bear some of the radial loads applied to the cutters and drill bit.

Figure 7:
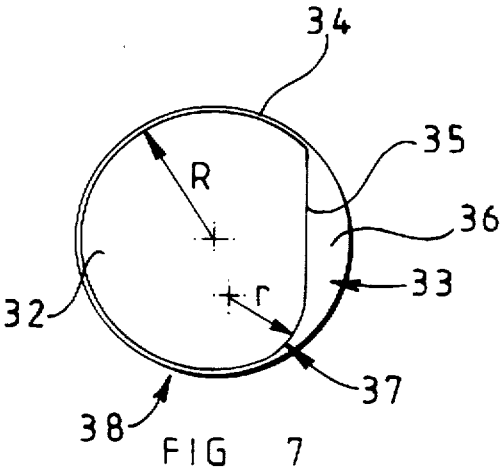
FIG. 7 is a plan view of a further form of gauge cutter in accordance with the invention.
Figure 8:
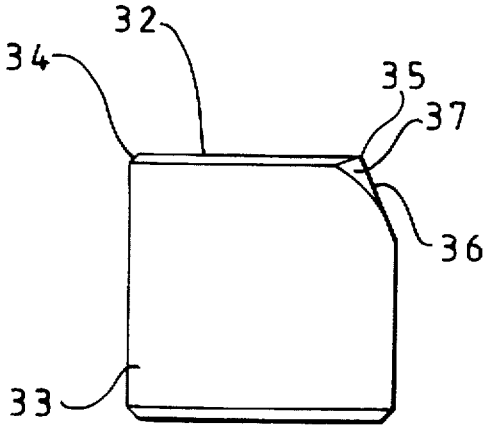
FIG. 8 is a side view of the cutter of FIG. 7.

Such an arrangement is shown in FIGS. 7 and 8. In this case the cutter comprises a facing table 32 of polycrystalline diamond bonded to a cylindrical substrate 33 of cemented tungsten carbide. The substrate 33 is of sufficient axial length that it may be directly mounted in a socket in the bit body and does not require to be brazed to a carrier as is the case with thinner cutters. The diamond facing table 32 is beveled round its periphery as indicated at 34. In the present instance the bevel 34 is frusto-conical, but it could equally well be radiused as viewed in cross-section.

As in the previous arrangements the cutter has a substantially straight cutting edge 35. However, in this case the substrate 33 is circular in cross section and the straight cutting edge 35 is formed by forming a flat chamfer 36 across one side of the substrate 33 adjacent the facing table 32. The angle of the chamfer 36 is such that when the cutter is mounted in the appropriate orientation in the gauge section of the drill bit, the chamfer 36 is substantially tangential to the surrounding formation in the wall of the borehole so that the chamfer portion provides an increased area to absorb lateral impact loads due to engagement of the cutter with the formation. Although the chamfer 36 is shown as flat, it might also be slightly curved to the overall radius of the drill bit, as it extends away from the straight edge, so as to be concentric with the surrounding formation.

In accordance with the present invention the junction 37 between one end of the straight cutting edge 35 and the remainder of the peripheral surface 38 of the cutter is chamfered, in the form of a part-circular arc, to provide a gradual transition between the end of the cutting edge and the peripheral surface so as to reduce stress concentrations in this region. In the case where the cutter has an overall radius R of 6.7 mm, the radius of curvature of the chamfer 37 may be 3.8 mm. In this case, where only one junction is chamfered, the chamfer junction 37 is disposed lowermost when the bit is drilling downwardly.

In any of the arrangements according to the invention, a buffer or transition layer may be provided between the superhard facing table and the substrate. For example, the transition layer may comprise a material the critical properties of which are intermediate the properties of the materials of the facing table and the substrate. Alternatively or additionally, the interface between the facing table and the substrate, the interface between the facing table and the transition layer, and/or the interface between the transition layer and the substrate, may be configured and non-planar to enhance the bonding between the layers.

Whereas the present invention has been described in particular relation to the drawings attached hereto, it should be understood that other and further modifications, apart from those shown or suggested herein, may be made within the scope and spirit of the present invention

What is claimed:

1. A preform cutting element for a rotary drag-type drill bit including a facing table of superhard material having a front face, a peripheral surface, and a rear surface bonded to a substrate of a material which is less hard than the superhard material, the peripheral surface of the cutting element including a single substantially straight cutting edge having at opposite ends thereof junctions with the remainder of said peripheral surface, at least one of said junctions being formed with a smoothly curved chamfer which provides a continuous transition between the end of the cutting edge and the adjacent portion of the remainder of the peripheral surface of the cutting element.

2. A cutting element according to claim 1, wherein both said junctions are chamfered.

3. A cutting element according to claim 1, wherein the chamfer is in the form of a part-circular arc, opposite ends of which are substantially tangential to the cutting edge and the remainder of the peripheral surface respectively.

4. A cutting element according to claim 2, wherein each chamfer is in the form of a part-circular arc, opposite ends of which are substantially tangential to the cutting edge and the remainder of the peripheral surface respectively, and the two part-circular arcs are of substantially the same radius.

5. A cutting element according to claim 1, wherein the remainder of the peripheral surface of the cutting element is part-circular.

6. A cutting element according to claim 5, wherein said part-circular portion of the peripheral surface has an angular extent which is greater than 180°.

7. A cutting element according to claim 6, wherein the angular extent of the part-circular portion of the peripheral surface is in the range of 210°–270°.

8. A cutting element according to claim 1, wherein the chamfer is in the form of a part-circular arc, and the remainder of the peripheral surface of the cutting element is part-circular, and the ratio of the radius of curvature of the chamfer to the radius of curvature of the peripheral surface is in the range of 1:1.4 to 1:1.8.

9. A cutting element according to claim 8, wherein the radius of curvature of the peripheral surface is about 6.5 mm and the radius of curvature of the chamfer is about 4 mm.

10. A cutting element according to claim 8, wherein the radius of curvature of the peripheral surface is about 9.5 mm and the radius of curvature of the chamfer is about 6.5 mm.

11. A cutting element according to claim 1, wherein the straight cutting edge is formed at the junction between the facing table and a flat on the substrate which extends substantially at right angles to the facing table and across the entire thickness of the substrate.

12. A cutting element according to claim 1, wherein the straight cutting edge is formed at the junction between the facing table and an inclined surface on the substrate which extends at an angle from the cutting edge to the peripheral surface of the substrate.

13. A cutting element according to claim 1, wherein at least part of the peripheral edge of the facing table is bevelled.

14. A cutting element according to claim 1, wherein the interface between the facing table and the substrate is configured and non-planar.

15. A cutting element according to claim 1, wherein a transition layer is provided between the facing table and the substrate having at least one property which is intermediate the corresponding property of the facing table and substrate.

16. A cutting element according to claim 2, wherein the interface between the transition layer and at least one of the facing table and substrate is configured and non-planar.

17. A cutting structure for a rotary drag-type drill bit comprising a preform cutting element bonded to a carrier, the preform cutting element including a facing table of superhard material having a front face, a peripheral surface, and a rear surface bonded to a substrate of a material which is less hard than the superhard material, the peripheral surface of the cutting element including a single substantially straight cutting edge having at opposite ends thereof junctions with the remainder of said peripheral surface, the substrate of the cutting element being bonded to the carrier in an orientation to expose said straight cutting edge to cut formation to which the cutting structure is applied, and at least one of said junctions being formed with a chamfer which provides a transition between the end of the cutting edge and the adjacent portion of the remainder of the peripheral surface of the cutting element.

18. A cutting element according to claim 17, wherein both said junctions are chamfered.

19. A cutting element according to claim 17, wherein the chamfer is smoothly curved to provide a continuous transition between the end of the cutting edge and the adjacent portion of the remainder of the peripheral surface.

20. A cutting element according to claim 19, wherein the chamfer is in the form of a part-circular arc, opposite ends of which are substantially tangential to the cutting edge and the remainder of the peripheral surface respectively.

21. A cutting element according to claim 18, wherein each chamfer is in the form of a part-circular arc, opposite ends of which are substantially tangential to the cutting edge and the remainder of the peripheral surface respectively, and the two part-circular arcs are of substantially the same radius.

22. A cutting element according to claim 17, wherein the remainder of the peripheral surface of the cutting element is part-circular.

23. A cutting element according to claim 22, wherein said part-circular portion of the peripheral surface has an angular extent which is greater than 180°.

24. A cutting element according to claim 23, wherein the angular extent of the part-circular portion of the peripheral surface is in the range of 210°–270°.

25. A cutting element according to claim 17, wherein the chamfer is in the form of a part-circular arc, and the remainder of the peripheral surface of the cutting element is part-circular, and the ratio of the radius of curvature of the chamfer to the radius of curvature of the peripheral surface is in the range of 1:1.4 to 1:1.8.

26. A cutting element according to claim 25, wherein the radius of curvature of the peripheral surface is about 6.5 mm and the radius of curvature of the chamfer is about 4 mm.

27. A cutting element according to claim 25, wherein the radius of curvature of the peripheral surface is about 9.5 mm and the radius of curvature of the chamfer is about 6.5 mm.

28. A cutting element according to claim 17, wherein the straight cutting edge is formed at the junction between the facing table and a flat on the substrate which extends substantially at right angles to the facing table and across the entire thickness of the substrate.

29. A cutting element according to claim 17, wherein the straight cutting edge is formed at the junction between the facing table and an inclined surface on the substrate which extends at an angle from the cutting edge to the peripheral surface of the substrate.

30. A cutting element according to claim 17, wherein at least part of the peripheral edge of the facing table is bevelled.

31. A cutting element according to claim 17, wherein the interface between the facing table and the substrate is configured and non-planar.

32. A cutting element according to claim 17, wherein a transition layer is provided between the facing table and the substrate having at least one property which is intermediate the corresponding property of the facing table and substrate.

33. A cutting element according to claim 32, wherein the interface between the transition layer and at least one of the facing table and substrate is configured and non-planar.

34. A preform cutting element for a rotary drag-type drill bit including a facing table of superhard material having a front face, a peripheral surface, and a rear surface bonded to a substrate of a material which is less hard than the superhard material, the peripheral surface of the cutting element including a substantially straight cutting edge having at opposite ends thereof junctions with the remainder of said peripheral surface, at least one of said junctions being formed with a chamfer which provides a transition between the end of the cutting edge and the adjacent portion of the remainder of the peripheral surface of the cutting element, the straight cutting edge being formed at the junction between the facing table and an inclined surface on the substrate which extends only along the straight cutting edge and extends at an angle from the cutting edge to the peripheral surface of the substrate.

35. A rotary drag-type drill bit having a longitudinal axis of rotation and comprising a bit body having mounted thereon a plurality of preform cutting elements, at least one of said elements including a facing table of superhard material having a front face, a peripheral surface, and a rear surface bonded to a substrate of a material which is less hard than the superhard material, the peripheral surface of the cutting element including a substantially straight cutting edge which extends generally parallel to the longitudinal axis of the drill bit, so as to form a cylindrical side wall of a borehole being drilled, in use, the straight cutting edge having at opposite ends thereof junctions with the remainder of said peripheral surface, at least one of said junctions being formed with a chamfer which provides a transition between the end of the cutting edge and the adjacent portion of the remainder of the peripheral surface of the cutting element.

36. A rotary drill bit according to claim 35, wherein both said junctions of the cutting edge are chamfered.

37. A rotary drill bit according to claim 35, wherein the chamfer is smoothly curved to provide a continuous transition between the end of the cutting edge and the adjacent portion of the remainder of the peripheral surface.

38. A rotary drill bit according to claim 37, wherein the chamfer is in the form of a part-circular arc, opposite ends of which are substantially tangential to the cutting edge and the remainder of the peripheral surface respectively.

39. A rotary drill bit according to claim 36, wherein each chamfer is in the form of a part-circular arc, opposite ends of which are substantially tangential to the cutting edge and the remainder of the peripheral surface respectively, and the two part-circular arcs are of substantially the same radius.

40. A rotary drill bit according to claim 35, wherein the remainder of the peripheral surface of the cutting element is part-circular.

41. A rotary drill bit according to claim 40, wherein said part-circular portion of the peripheral surface has an angular extent which is greater than 180°.

42. A rotary drill bit according to claim 41, wherein the angular extent of the part-circular portion of the peripheral surface is in the range of 210°–270°.

43. A rotary drill bit according to claim 35, wherein the chamfer is in the form of a part-circular arc, and the remainder of the peripheral surface of the cutting element is part-circular, and the ratio of the radius of curvature of the chamfer to the radius of curvature of the peripheral surface is in the range of 1:1.4 to 1:1.8.

44. A rotary drill bit according to claim 43, wherein the radius of curvature of the peripheral surface is about 6.5 mm and the radius of curvature of the chamfer is about 4 mm.

45. A rotary drill bit according to claim 43, wherein the radius of curvature of the peripheral surface is about 9.5 mm and the radius of curvature of the chamfer is about 6.5 mm.

46. A rotary drill bit according to claim 35, wherein the straight cutting edge is formed at the junction between the facing table and a flat on the substrate which extends substantially at right angles to the facing table and across the entire thickness of the substrate.

47. A rotary drill bit according to claim 35, wherein the straight cutting edge is formed at the junction between the facing table and an inclined surface on the substrate which extends at an angle from the cutting edge to the peripheral surface of the substrate.

48. A rotary drill bit according to claim 35, wherein at least part of the peripheral edge of the facing table is bevelled.

49. A rotary drill bit according to claim 35, wherein the interface between the facing table and the substrate is configured and non-planar.

50. A rotary drill bit according to claim 35, wherein a transition layer is provided between the facing table and the substrate having at least one property which is intermediate the corresponding property of the facing table and substrate.

51. A rotary drill bit according to claim 35, wherein the interface between the transition layer and at least one of the facing table and substrate is configured and non-planar.

* * * * *